US006431954B1

(12) United States Patent
Junker

(10) Patent No.: US 6,431,954 B1
(45) Date of Patent: Aug. 13, 2002

(54) METHOD AND APPARATUS FOR GRINDING WORKPIECES WITH PRECISION WORK PERFORMED AT THE SAME TIME AS THE GRINDING

(75) Inventor: Erwin Junker, Buhl (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 09/581,716

(22) PCT Filed: Sep. 11, 1998

(86) PCT No.: PCT/EP98/05808

§ 371 (c)(1),
(2), (4) Date: Aug. 4, 2000

(87) PCT Pub. No.: WO99/32258

PCT Pub. Date: Jul. 1, 1999

(30) Foreign Application Priority Data

Dec. 18, 1997 (DE) ..... 197 56 610

(51) Int. Cl.[7] ..... B24B 49/00

(52) U.S. Cl. ..... 451/11; 451/50; 451/177; 451/385; 451/397

(58) Field of Search ..... 451/11, 50, 177, 451/385, 397

(56) References Cited

U.S. PATENT DOCUMENTS 3,881,887 A 5/1975 McMaster
4,222,203 A * 9/1980 Wolff et al. ..... 451/52
4,907,374 A * 3/1990 Brill ..... 451/342
4,930,265 A * 6/1990 Belthle ..... 451/11
5,224,300 A 7/1993 Pineau

FOREIGN PATENT DOCUMENTS

DE 23 33 041 A1 1/1975
DE 41 01 150 A1 7/1992
DE 42 27 315 A1 2/1993

* cited by examiner

*Primary Examiner*—Joseph J. Hail, III
*Assistant Examiner*—Shantese McDonald
(74) *Attorney, Agent, or Firm*—Brian C. McCormack; Baker & McKenzie

(57) ABSTRACT

A description is given of an apparatus and a method for grinding a workpiece, in particular a shaft part. According to the method, the workpiece is clamped in place for the grinding working and its geometry is subsequently ground in such a way as to maintain its dimensions and shape. According to the invention, at least part of the surface of the workpiece is precision-worked at least partly at the same time as the grinding. The apparatus according to the invention has a work-spindle headstock and a tailstock for clamping the workpiece in place as well as a grinding unit with a grinding wheel for grinding the workpiece. The grinding unit and workpiece are arranged movably in relation to each other in a controlled manner. The apparatus according to the invention additionally has a precision-working unit, which can be moved according to the geometry of the workpiece in such a way that at least part of the surface of the workpiece is able to undergo precision working.

34 Claims, 4 Drawing Sheets

METHOD AND APPARATUS FOR GRINDING WORKPIECES WITH PRECISION WORK PERFORMED AT THE SAME TIME AS THE GRINDING

The invention relates to a method for grinding a workpiece and an apparatus for carrying out that method.

The components needed in engine and gear construction in particular require very exacting production tolerances. These exacting production tolerances are mainly achieved by fine working and subsequent precision working. Bearing seats or other portions of components subjected to great loading in later use are therefore often initially ground and subsequently further subjected to precision working, in order to achieve the required shape and surface quality with regard to service life and running properties.

The fine working and precision working are generally two successive operations on two machine tools respectively designed for each specific purpose. A disadvantage of this is that, on the one hand, the number of different machine tools greatly increases the investment expenditure required to realize the production of a specific component and that, on the other hand, the production costs for the component concerned are likewise increased by higher processing times with intermediate transporting operations. A further disadvantage is that the re-chucking in the machine tool performing the precision working can cause errors which prove to be disadvantageous for the production tolerances required.

Methods of precision working include honing in particular. Honing is a method of machining with bonded abrasive grain for improving or changing the shape, dimensional accuracy and surface quality of the workpiece, with the tool constantly engaging the surface of the workpiece. Honing is generally used after preceding fine working, such as grinding for example, as a finishing operation. So-called superfinishing in particular is also referred to as fine honing.

There are known machine tools for grinding and known machine tools for superfinishing for example (see company brochure IMPCO Machine Tools, USA, 1994). In addition to the disadvantages described above with regard to investment expenditure and production expenditure, the concept of two respectively different machine tools, for fine working and precision working, also represents a considerable development expenditure.

The invention is therefore based on the object of providing a method and an apparatus for working workpieces by means of which the geometry of the workpiece is worked in such a way as to maintain its dimensions and shape and provide it with the required surface quality, and the production time and consequently the unit costs of the workpiece are reduced considerably.

This object is achieved by a method having the features described herein and by an apparatus for carrying out the method having the features described herein.

In the method for grinding a workpiece, in particular a shaft part of a gear mechanism, the workpiece is clamped in place for working and the geometry of the workpiece is ground in such a way as to maintain its dimensions and shape. According to the invention, at least part of the surface of the workpiece is precision-worked at least partly at the same time as the grinding. The precision working is preferably performed by finishing.

According to one exemplary embodiment, the grinding and the precision working are performed on cylindrical and/or conical portions of the surface of the workpiece.

The apparatus used for carrying out the method according to the invention for grinding a workpiece is used in particular for grinding shaft parts, for example of a gear mechanism. The apparatus has a work-spindle headstock and a tailstock for clamping the workpiece in place as well as a grinding unit. The grinding unit is provided with at least one grinding spindle, which bears a grinding wheel for grinding the workpiece. The work-spindle headstock and the tailstock and/or the grinding unit are arranged movably in a controlled manner between the grinding unit and the workpiece for achieving relative movement in grinding, producing the desired workpiece geometry. According to the invention, the apparatus is provided with a precision-working unit, which can be moved according to the geometry of the workpiece, at least part of the surface of the workpiece being able to undergo precision working by means of the precision-working unit.

According to a preferred exemplary embodiment, the grinding unit and the precision-working unit are movable in such a way that at least some of the time they are simultaneously in engagement with the workpiece.

This makes it possible for the first time to carry out complete working of a workpiece, i.e. fine working and precision working, on one machine tool. This dispenses with external linkages for a number of operations, possibly with transporting procedures in between. Since it is no longer necessary for two different machine tools to be installed, for the fine working and the precision working, consequently the investment requirement, the overall costs and also the unit costs can be reduced considerably. In addition, the necessary space requirement is less, since there is a smaller number of machines with the same output on a defined production area. Furthermore, the processing and storage times are reduced as a result. Production can be made more transparent overall. Further advantages of the invention are that the number of machine suppliers can be reduced, since there is an identical machine concept for a machine which performs both the fine working and the precision working. This leads to considerable advantages in the servicing and maintenance area as well.

According to a further exemplary embodiment of the invention, the grinding unit and the precision-working unit are preferably arranged essentially opposite each other with respect to the longitudinal axis of the workpiece, so that the workpiece is clamped in place between the two working units. This has the advantage that both the grinding unit and the precision-working unit have freedom of movement, without hindering each other. In addition, with such an arrangement of the grinding unit and precision-working unit, simultaneous grinding and precision working of the workpiece are performed essentially over the entire length of the workpiece.

According to a further exemplary embodiment, it is also possible preferably to arrange the grinding unit and the precision-working unit essentially on one side of the workpiece with respect to the longitudinal axis of the workpiece. This is advantageous for example whenever only part of the surface of the workpiece has to be precision-worked and the length of the workpiece to be worked is great enough for the precision-working unit and the grinding unit not to hinder each other during simultaneous engagement with the workpiece In one embodiment, the grinding unit has a carrier, to which two grinding spindles each with at least one grinding wheel are attached in such a way that they can swivel and are on a common infeed axis such that the grinding wheels can successively be brought into engagement with the workpiece. Such a grinding unit is advisable in particular whenever different surface contours of the workpiece are to be worked in such a way as to maintain its dimensions and shape by means of the grinding unit.

The precision-working unit is preferably designed as a precision-grinding unit or as a finishing unit. Both the precision-grinding unit and the finishing unit serve the purpose of achieving surface qualities of the workpiece or of part of the surface of this workpiece that lie in the range of the methods of production usually referred to as precision working.

Further advantages, features and application possibilities of the invention are explained in detail on the basis of exemplary embodiments with reference to the attached drawings, in which.

Figure 2:
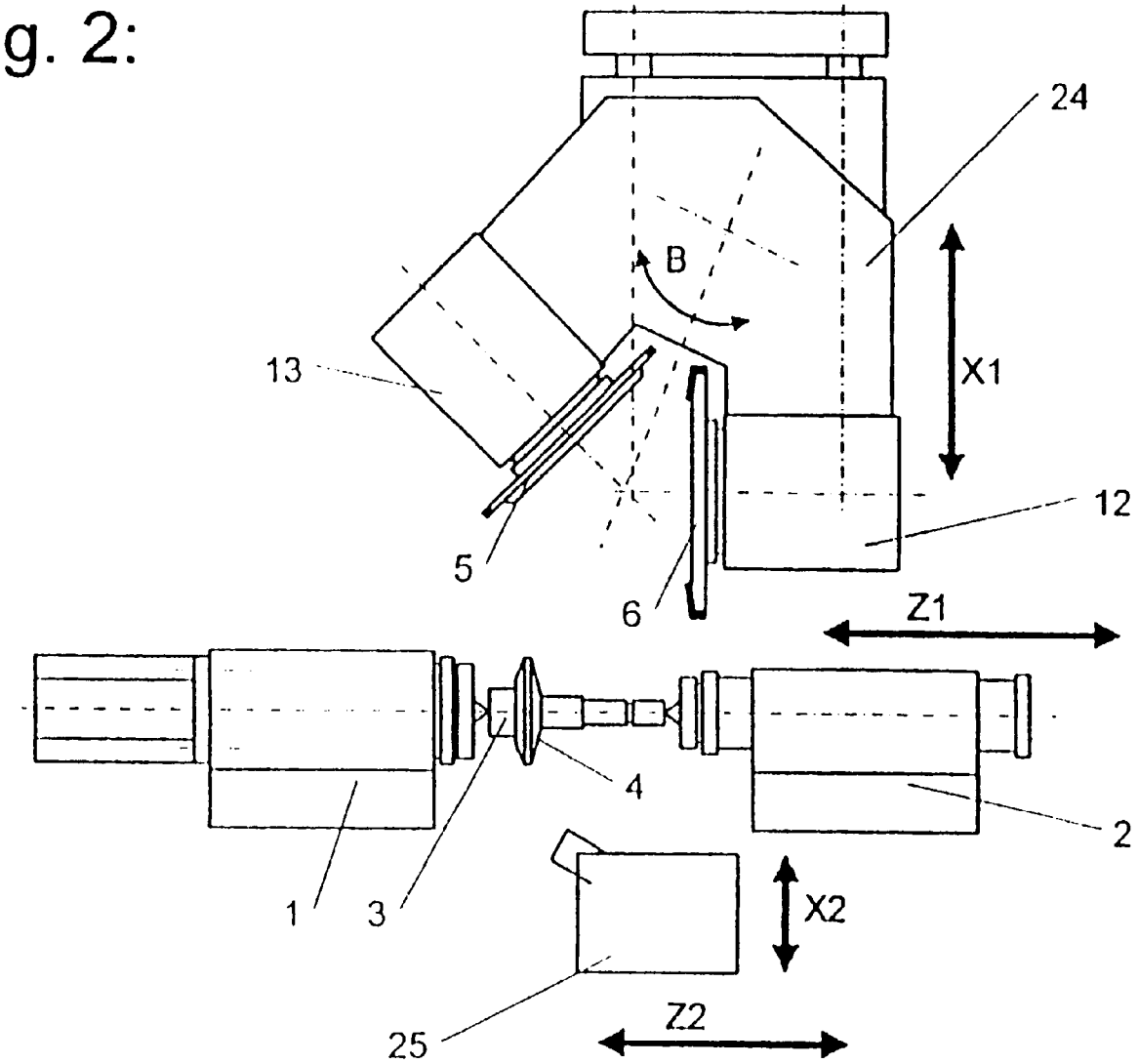
FIG. 2 shows a schematic plan view of the apparatus according to the invention according to a second exemplary embodiment of the invention.
Figure 2B:
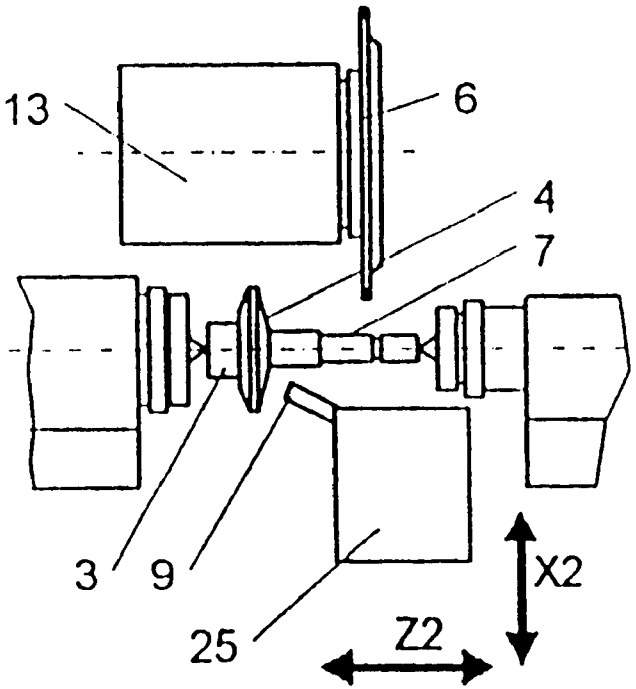
Figure 2A:
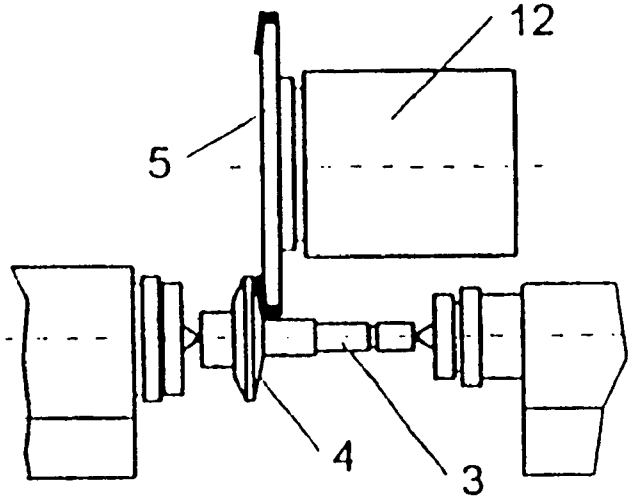
Figure 3:
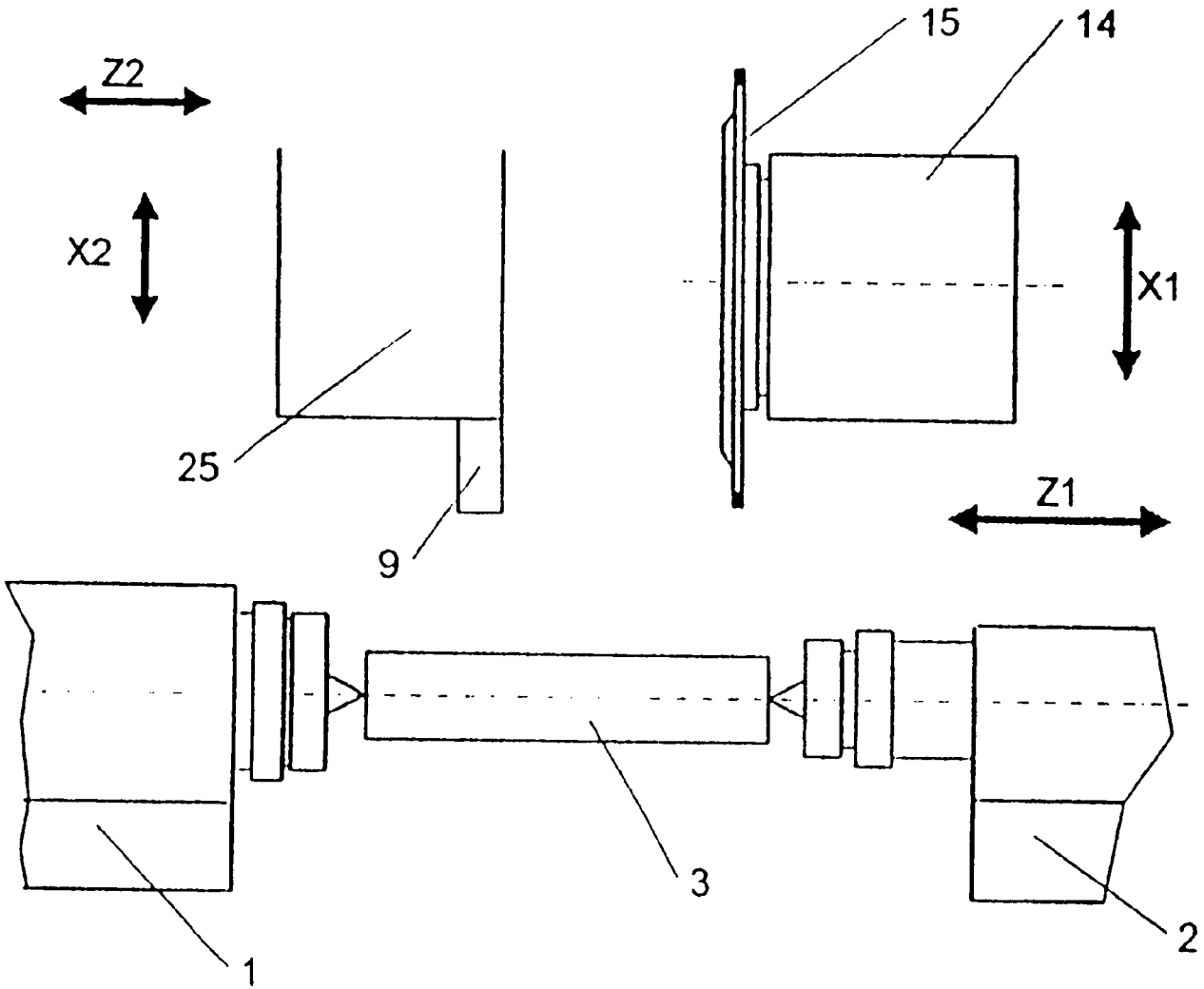

FIG. 2*a* shows the engagement of a first grinding spindle of the apparatus according to FIG. 2 on the workpiece;

FIG. 2*b* shows the infeeding of a second grinding spindle according to FIG. 2 and of the precision-working unit to the workpiece; and FIG. 3 shows a schematic plan view of the apparatus according to the invention according to a third exemplary embodiment.

Figure 1:
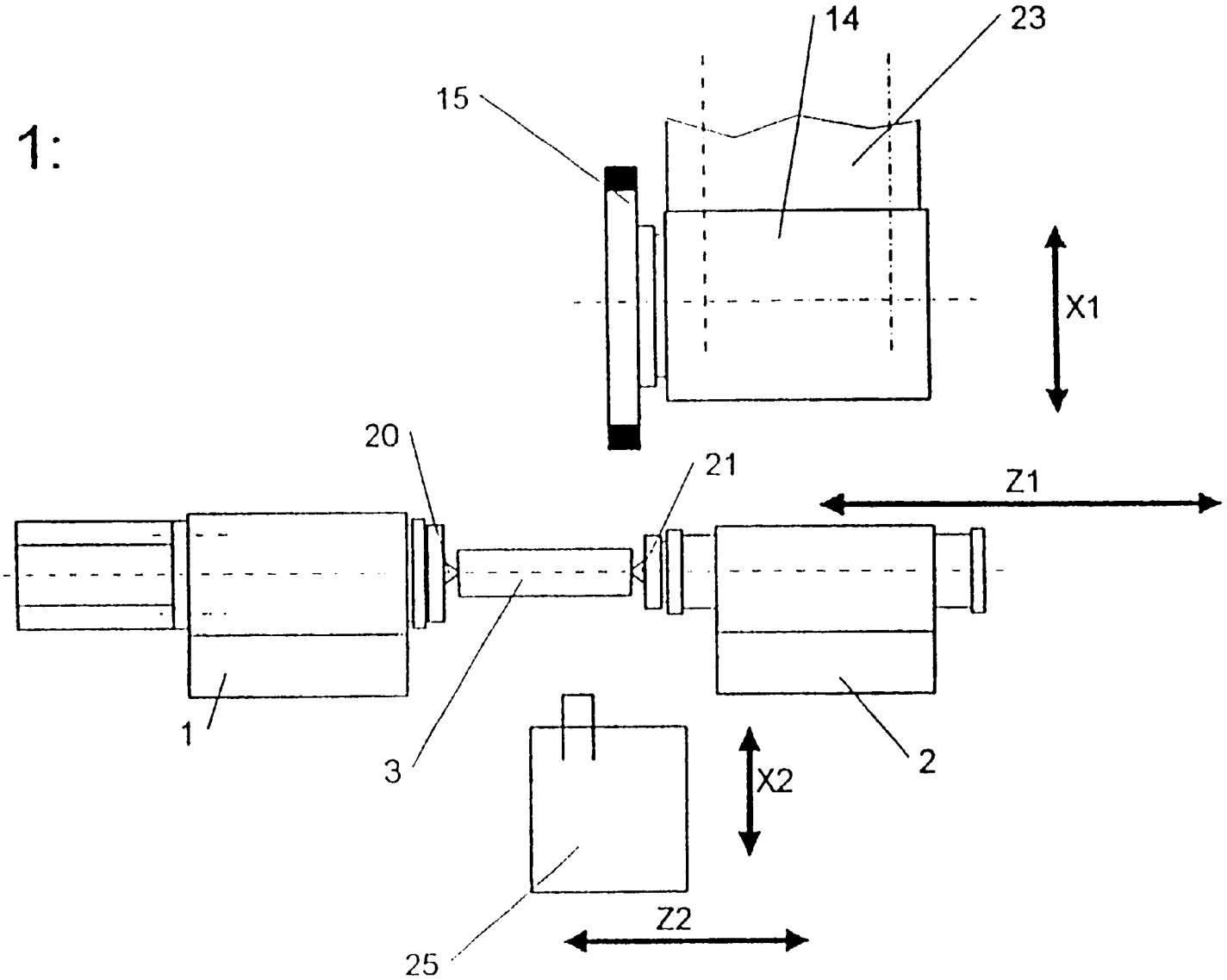
FIG. 1 shows a schematic plan view of the apparatus according to the invention according to a first exemplary embodiment.

Represented in FIG. 1 is the plan view of the apparatus according to the invention according to a first exemplary embodiment. Between a work-spindle headstock 1 and a tailstock 2, a workpiece 3 is clamped in place between centres 20, 21. In this case, the longitudinal axis of the workpiece 3 is aligned with the longitudinal axes of the spindles of the work-spindle headstock 1 and of the tailstock 2. The work-spindle headstock 1 and the tailstock 2 are arranged such that they can be moved on a movable grinding table (not represented) along a CNC axis Z1. On one side of the work-spindle headstock/workpiece/tailstock arrangement there is provided a grinding-spindle headstock 23. The grinding-spindle headstock 23 has a grinding spindle 14 with a grinding wheel 15. The grinding-spindle headstock 23 is arranged movably with respect to an axis of movement X1 in the sense of an infeed to the workpiece 3. The longitudinal axis of the grinding spindle 14 may be arranged such that it can swivel in parallel or horizontally with respect to the axis of the workpiece.

Instead of the work-spindle headstock 1 and the tailstock 2, the grinding-spindle headstock 23 may also be movable in the direction of the Z1 axis. In such a case, the work-spindle headstock 1 and the tailstock 2 are fixedly mounted on the machine stand. Arranged opposite the grinding-spindle headstock 23, in an essentially horizontal plane, is a precision-working unit 25.

By means of this precision-working unit 25, the surface of the workpiece 3 is re-worked according to the shape, tolerance and surface requirements, it being possible for the precision working to be carried out at the same time as the grinding wheel 15 engages the workpiece 3.

This precision-working unit 25 is provided for example with a superfinishing unit. The precision-working unit 25 is movable along two CNC axes X2 and Z2, arranged at right angles in relation to each other, so that it can execute movements independently of the grinding-spindle headstock 23. This exemplary embodiment, in which the grinding unit 14, 15, 23 and the precision-working unit 25 are arranged opposite the workpiece, has the advantage that essentially the entire surface of the workpiece 3 can be ground with the grinding unit 14, 15, 23 and at the same time can be precision-worked with the precision-working unit 25.

FIG. 2 shows the plan view of the apparatus according to the invention according to a second exemplary embodiment. An apparatus according to this exemplary embodiment is used in particular if the outer contour of the workpiece 3 has to be worked with at least two grinding wheels. On one side of the work-spindle headstock/workpiece/tailstock arrangement there is again provided a grinding-spindle headstock 24. This grinding-spindle headstock 24 bears two grinding spindles 12, 13 in a common horizontal plane, which are mounted at an angle in relation to each other on the grinding-spindle headstock 24. Each grinding spindle 12 and 13 bears a grinding wheel intended and shaped for a respective portion of the contour of the workpiece. The grinding-spindle headstock 24 can be swiveled about the point B, so that, according to the production sequence, the grinding wheel 5 mounted on the grinding spindle 13 or the grinding wheel 6 mounted on the grinding spindle 12 can be infed. The swiveling movement of the grinding-spindle headstock 24, which can be executed about the swivel axis B, is executed hydraulically or under CNC control.

Arranged opposite the grinding unit 12, 13, 24 in a way analogous to the exemplary embodiment according to FIG. 1 is the precision-working unit 25. The controlled movements of the grinding unit 12, 13, 24, of the precision-working unit 25 and of the work-spindle headstock/workpiece/tailstock arrangement are analogous to those described in connection with the exemplary embodiment according to FIG. 1.

In FIG. 2*a*, the grinding spindle 12 of the grinding-spindle headstock 24 is in engagement with the workpiece 3 for grinding a conical contour 4 by means of the grinding wheel 5. For the sake of overall clarity, both the grinding-spindle headstock 24 and the precision-working unit 25 are not depicted.

In FIG. 2*b*, the infeeding both of the grinding spindle 13 with the grinding wheel 6 of the grinding-spindle headstock 24 and of the precision-working unit 25 with a finishing stone 9 to the workpiece 3 is represented. With the grinding wheel 6, a cylindrical journal 7 is ground on the workpiece 3. The conical contour 4 of the workpiece 3 is at the same time subjected to a finishing operation, in order to increase the surface quality by means of the finishing stone 9. The use of a finishing stone of this type is advantageous in particular whenever high load-bearing elements are to be achieved with respect to the surface quality of the workpiece surface.

FIG. 3 shows the plan view of the apparatus according to the invention according to a third exemplary embodiment. According to this exemplary embodiment, both the grinding unit 14, 15 and the precision-working unit 25 are provided on one side of the work-spindle headstock/workpiece/tailstock arrangement. Both the grinding unit 14, 15 and the precision-working unit 25 are movable under CNC control along respective axes X1, Z1 and X2, Z2. This makes it possible to infeed the grinding wheel 15 and the finishing stone 9 to the workpiece 3 at least partly at the same time, at least at part of the surface of the workpiece, for the grinding and the precision working. For producing the relative movement between the grinding wheel or the finishing stone 9 and the workpiece 3 that is required for the grinding or precision-working, a movement of the grinding unit 14, 15 along the axes X1, Z1 or of the precision-grinding unit 25 along the axes X2, Z2 is possible, and the work-spindle headstock/workpiece/tailstock arrangement is mounted such that it is fixedly connected to a machine stand.

In particular in the case of gear parts which have cylindrical shaft portions with different diameters and, for example, conically formed or bevelled gear wheels, use of the apparatus and method according to the invention is advantageous, since the normal grinding and precision working can be performed at least partly at the same time and, as a result, considerable cost savings can be achieved.

What is claimed is:

1. A method for grinding a workpiece comprising:

(a) clamping said workpiece in a chucking set-up;

(b) grinding said workpiece in said chucking set-up with a grinding wheel, said grinding maintaining the approximate dimension and shape of said workpiece;

(c) precision-working at least a part of said workpiece within said chucking set-up with a rotationally fixed precision-working unit, said precision-working occurring at least partly at the same time as said grinding.

2. The method of claim 1, wherein said precision-working comprises finishing.

3. The method of claim 2, wherein said grinding is performed on a cylindrical portion of the workpiece.

4. The method of claim 2, wherein said grinding is performed on a conical portion of the workpiece.

5. The method of claim 2, wherein said precision-working is performed on a cylindrical portion of the workpiece.

6. The method of claim 2, wherein said precision-working is performed on a conical portion of the workpiece.

7. An apparatus for grinding a workpiece, said apparatus comprising:

(a) a work-spindle headstock;

(b) a work-spindle tailstock, said headstock and tailstock operable to clamp said workpiece;

(c) a spindle connected to one of said headstock and said tailstock, said spindle, headstock, and tailstock operable to hold the workpiece fixed translationally and rotatable about at least the spindle axis;

(d) a grinding unit operable to grind the workpiece, said grinding unit movably mounted in a controlled manner relative to said workpiece clamped by said headstock and tailstock; and (e) a rotationally fixed precision-working unit movably mounted in a controlled manner relative to said workpiece clamped by said headstock and tailstock, said precision-working unit further being operable to precision-work at least some portion of the surface of the workpiece at the same time as said grinding unit grinds said workpiece.

8. The apparatus of claim 7 wherein said grinding unit and said precision-working unit are movable in such a way that at least some of the time they are simultaneously in engagement with the workpiece.

9. The apparatus of claim 7 wherein said grinding unit and said precision-working unit are arranged generally opposite each other with the workpiece in between.

10. The apparatus of claim 7 wherein said grinding unit and said precision-working unit are arranged generally to be on the same side of the workpiece.

11. The apparatus of claim 7 wherein said grinding unit comprises a grinding-spindle headstock, to which two grinding spindles each with at least one grinding wheel are attached in such a way that they can swivel and are on a common infeed axis such that the grinding wheels can successively be brought into engagement with the workpiece.

12. The apparatus of claim 7 wherein said precision-working unit is a precision-grinding unit.

13. The apparatus of claim 7 wherein said precision-working unit is a finishing stone.

14. A method for grinding a workpiece comprising:

(a) clamping said workpiece in a chucking set-up;

(b) grinding said workpiece in said chucking set-up with a grinding wheel, said grinding maintaining the approximate dimension and shape of said workpiece;

(c) precision-working at least a part of said workpiece within said chucking set-up with a precision-working unit, said precision-working occurring at least partly at the same time as said grinding wherein the grinding wheel and the precision-working unit are arranged generally opposite each other with the workpiece in between.

15. The method of claim 14, wherein said precision-working comprises finishing.

16. The method of claim 14, wherein said grinding is performed on a cylindrical portion of the workpiece.

17. The method of claim 14, wherein said grinding is performed on a conical portion of the workpiece.

18. The method of claim 14, wherein said precision-working is performed on a cylindrical portion of the workpiece.

19. The method of claim 14, wherein said precision-working is performed on a conical portion of the workpiece.

20. A method for grinding a workpiece with a grinding unit comprising a grinding spindle headstock, to which two grinding spindles, each with at least one grinding wheel, are attached in such a way that they can swivel and are on a common infeed axis such that the grinding wheels can successively be brought into engagement with the workpiece, the method comprising:

(a) clamping said workpiece in a chucking set-up;

(b) grinding said workpiece in said chucking set-up with said at least one grinding wheel, said grinding maintaining the approximate dimension and shape of said workpiece;

(c) precision-working at least a part of said workpiece within said chucking set-up, said precision-working occurring at least partly at the same time as said grinding.

21. The method of claim 20, wherein said grinding is performed on a cylindrical portion of the workpiece.

22. The method of claim 20, where said grinding is performed on a conical portion of the workpiece.

23. The method of claim 20, wherein said precision-working is performed on a cylindrical portion of the workpiece.

24. The method of claim 20, wherein said precision-working is performed on a conical portion of the workpiece.

25. The method of claim 20, wherein said precision-working comprises finishing.

26. An apparatus for grinding a workpiece, said apparatus comprising:

(a) a work-spindle headstock;

(b) a work-spindle tailstock, said headstock and tailstock operable to clamp said workpiece;

(c) a spindle connected to one of said headstock and said tailstock, said spindle, headstock, and tailstock operable to hold the workpiece fixed translationally and rotatable about at least the spindle axis;

(d) a grinding unit operable to grind the workpiece, said grinding unit movably mounted in a controlled manner relative to said workpiece clamped by said headstock and tailstock; and (e) a precision-working unit movably mounted in a controlled manner relative to said workpiece clamped by said headstock and tailstock, said precision-working unit further being operable to precision-work at least some portion of the surface of the workpiece at the same time as said grinding unit grinds said workpiece, wherein said grinding unit and said precision-working unit are arranged generally opposite each other with the workpiece in between.

27. The apparatus of claim 26 wherein said grinding unit and said precision-working unit are movable in such a way that at least some of the time they are simultaneously in engagement with the workpiece.

28. The apparatus of claim 26 wherein said precision-working unit is a precision grinding unit.

29. The apparatus of claim 26 wherein said precision-working unit is a finishing stone.

30. An apparatus for grinding a workpiece, said apparatus comprising:

(a) a work-spindle headstock;

(b) a work-spindle tailstock, said headstock and tailstock operable to clamp said workpiece;

(c) a spindle connected to one of said headstock and said tailstock, said spindle, headstock, and tailstock operable to hold the workpiece fixed translationally and rotatable about at least the spindle axis;

(d) a grinding unit operable to grind the workpiece, said grinding unit movably mounted in a controlled manner relative to said workpiece clamped by said headstock and tailstock wherein said grinding unit has a grinding-spindle headstock, to which two grinding spindles each with at least one grinding wheel are attached in such a way that they can swivel and are on a common infeed axis such that the grinding wheels can successively be brought into engagement with the workpiece; and (e) a precision-working unit movably mounted in a controlled manner relative to said workpiece clamped by said headstock and tailstock, said precision-working unit further being operable to precision-work at least some portion of the surface of the workpiece at the same time as said grinding unit grinds said workpiece.

31. The apparatus of claim 30 wherein said grinding unit and said precision-working unit are movable in such a way that at least some of the time they are simultaneously in engagement with the workpiece.

32. The apparatus of claim 30 wherein said grinding unit and said precision-working unit are arranged generally opposite each other with the workpiece in between.

33. The apparatus of claim 30 wherein said precision-working unit is a precision-grinding unit.

34. The apparatus of claim 30 wherein said precision-working unit is a finishing stone.

* * * * *

UNITED STATES PATENT AND TRADEMARK OFFICE

CERTIFICATE OF CORRECTION

PATENT NO. : 6,431,954 B1
DATED : August 13, 2002
INVENTOR(S) : Junker

It is certified that error appears in the above-identified patent and that said Letters Patent is hereby corrected as shown below:

Title page,
Item [86], delete date "August 4, 2000" and insert in lieu thereof -- June 16, 2000 --.

Signed and Sealed this

Twenty-second Day of April, 2003

JAMES E. ROGAN
*Director of the United States Patent and Trademark Office*